US006348835B1

(12) United States Patent
Sato et al.

(10) Patent No.: US 6,348,835 B1
(45) Date of Patent: Feb. 19, 2002

(54) SEMICONDUCTOR DEVICE WITH CONSTANT CURRENT SOURCE CIRCUIT NOT INFLUENCED BY NOISE

(75) Inventors: Tomohiko Sato; Shyuichi Tsukada, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/578,500

(22) Filed: May 26, 2000

(30) Foreign Application Priority Data

May 27, 1999 (JP) ..... 11-148788

(51) Int. Cl.[7] ..... G05F 1/10
(52) U.S. Cl. ..... 327/543
(58) Field of Search ..... 323/315; 327/530, 327/538, 543

(56) References Cited

U.S. PATENT DOCUMENTS 5,625,282 A * 4/1997 Kawahara ..... 323/315
5,726,563 A * 3/1998 Bolton, Jr. ..... 323/315
5,945,873 A * 8/1999 Antone et al. ..... 327/541
5,955,874 A * 9/1999 Zhou et al. ..... 323/315
6,081,108 A * 6/2000 Mashal ..... 323/315

FOREIGN PATENT DOCUMENTS

JP 2-115911 4/1990
JP 2-256306 10/1990
JP 3-65715 3/1991
JP 3-206509 9/1991
JP 4-97405 3/1992
JP 5-191166 7/1993
JP 10-322163 12/1998

* cited by examiner

*Primary Examiner*—Jeffrey Zweizig
(74) *Attorney, Agent, or Firm*—McGinn & Gibb, PLLC

(57) ABSTRACT

A semiconductor device with a constant current source circuit includes a current mirror circuit including first and second transistors, third and fourth transistors, a first resistor and a potential change transferring section. In the current mirror circuit, the first and second transistors are connected to a line of a power supply potential and supply first and second currents, respectively. Each of the third and fourth transistors has a control electrode and first and second electrodes. The control electrode is operatively coupled to a first potential. The first electrode and the control electrode in the third transistor are connected to a first node, and the control electrode of the fourth transistor is connected to the first node. The third and fourth transistors receive the first and second currents at the first electrodes from the current mirror circuit, respectively. The first resistor is connected between the second electrode of the fourth transistor and a second node. The potential change transferring section is connected to a second potential and the second node such that a change of potential difference between the first potential and the second potential is transferred to the second electrodes of the third and fourth transistors.

21 Claims, 13 Drawing Sheets

SEMICONDUCTOR DEVICE WITH CONSTANT CURRENT SOURCE CIRCUIT NOT INFLUENCED BY NOISE

BACKGROUND OF THE INVENTION

1. Field of the Invention

The present invention relates to a semiconductor device with a constant current source circuit which is not influenced by noise.

2. Description of the Related Art

A conventional constant current source circuit 10 is shown in FIG. 1. The conventional constant current source circuit 10 is composed of a constant current source section 11 and an output section 12.

The constant current source section 11 is composed of two N-channel MOS transistors M1 and M2, and two P-channel MOS transistors M3 and M4. The transistor M1 has a source directly connected to the ground (GND), and a gate and a drain connected directly to each other. The transistor M2 is connected at its source via a resistor $R_1$ to the ground, at its gate to the drain of the transistor M1, and at its drain to the drain of the transistor M4. The two P-channel MOS transistors M3 and M4 are connected at their sources commonly to a power supply potential $V_{CC}$ and at their gates to each other. The drain of the transistor M3 is connected directly to the drain and gate of the transistor M1. The drain of the transistor M4 is connected directly to the gate of the transistor M4 and to the drain of the transistor M2. The transistors M3 and M4 form a current mirror circuit for driving the transistors M1 and M2. The transistors M1 to M4 form a Widlar current mirror circuit.

The output section 12 is composed of a P-channel MOS transistor M5. The transistor M5 is connected at its source directly to the power supply potential $V_{CC}$ and at the gate to a node C between the drain of the transistor M2 and the drain of the transistor M4 in the constant current source section 11. An output current Iout is outputted from a node F connected to the drain of the transistor M5.

Next, the operation principle of the constant current source circuit 10 will be described. Supposing that the current at the drain of the transistor M3 is I1 and the current at the drain of the transistor M4 is I2 in the current mirror circuit of the transistors M3 and M4, a ratio between the transistor M3 ratio and the transistor M4 ratio is expressed as I1:I2. The ratio indicates a ratio of the gate widths or the sizes of the transistors. For simplifying the description of the operation principle, it is supposed that the M3 ratio is equal to the M4 ratio, i.e., the transistors M3 and M4 are identical in capability ratio and the M2 ratio is equal to 10 times of the M1 ratio.

FIG. 2 is a graph showing sub-threshold characteristics of the transistors M1 and M2. As seen from FIG. 2, when the same gate—source voltage $V_{GS}$ is applied to the transistors M1 and M2, the transistor M2 flows a current 10 times greater than that of the transistor M1.

As shown in FIG. 2, the voltage V1 at the current I1 of the transistor M1 is equal to the gate—source voltage $V_{GS}$ of the transistor M1. More particularly, the voltage V1 is a voltage at a node B shown in FIG. 1. The voltage V2 at the current 12 of the transistor M2 is equal to the voltage $V_{GS}$ of the transistor M2. More specifically, (voltage V2)=(voltage at node B)−(voltage at a node D). If the voltage difference (V1−V2) is equal to ΔV, the voltage difference ΔV is an electromotive force due to the resistor $R_1$, and I2=$\Delta V/R_1$ is satisfied. The voltage difference ΔV is equal to a sub-threshold coefficient. The sub-threshold coefficient is defined as the voltage difference $\Delta V_{GS}$ necessary to change the current for one digit.

The output current Iout is determined as $(\Delta V/R_1)\times$(M5 ratio/M4 ratio). Thus, the current outputted from the constant current circuit becomes a constant current.

It should be noted that the M3 ratio is equal to the M4 ratio for simple description in the above. However, the ratios of the transistors are not limited to them. The output current Iout is determined depending on the ratios of the transistors M1 to M5 and the resistance of the resistor $R_1$.

The conventional constant current source circuit 10 described above may be used, for example, in a reference voltage generating circuit shown in FIG. 3. In the reference voltage generating circuit 20, a node F in the constant current source circuit 10 is connected to the ground via a resistor r and a diode D1. An output voltage Vout is outputted from the node F.

As shown in FIG. 2, as the temperature is increased, the inclination of the sub-threshold curves becomes small due to the transistor characteristics. As a result, the sub-threshold coefficient increases. Hence, as the temperature is increased, the voltage difference ΔV is also increased. This results in the increase of the output current Iout from the constant current source circuit 10 so that the electromotive force of the resistor r, i.e., (Vout)−(voltage at node G) is increased. Meanwhile, as the temperature is increased, the built-in potential of the diode D1 becomes low. This results in the decrease of the voltage at the node G in a higher temperature. Thus, the output current Iout is controlled using the ratios of the transistors M1 to M5 and the resistance of the resistors $R_1$ and r so that the influence due to the temperature characteristic can be cancelled. Therefore, the output reference voltage Vout can be obtained free from variations in the temperature. Also, when the resistors $R_1$ and r are formed of the same material at the same time, changes in their resistances caused by the temperature change or the production deviation can be cancelled as shown in FIG. 4.

In a DRAM employing an N-channel transistor as a memory cell transistor, the substrate potential ($V_{BB}$) of the memory cell transistor is needed to be set to a negative value for the improvement of the hold characteristic of the memory cell.

The well structures in the DRAM are classified into two types, a twin well and a triple well. In the twin well type, the substrate potential of an N-channel transistor in a peripheral circuit (a logic section) on a P-type substrate is set to $V_{BB}$, because the substrate potential is common to that of a memory cell section. On the contrary, in the triple well type, the substrate potential of an N-channel transistor in the peripheral circuit is electrically isolated from the substrate potential of the memory cell section. Therefore, both of the substrate potentials can be determined individually and independently. While the substrate potential of the memory cell section is the potential $V_{BB}$, the substrate potential of the peripheral circuit is the GND potential.

The constant current source circuit 10 shown in FIG. 1 is formed in a peripheral circuit. In the triple well type, the substrate potential of the N-channel transistor in the peripheral circuit is the GND potential and not affected by the $V_{BB}$ noise. That is, the $V_{BB}$ noise has no influence in the constant current source circuit 10 shown in FIG. 1. On the other hand, in a twin well type, it is necessary to remove the $V_{BB}$ noise. Adoption of the twin well type reduces the manufacturing cost, compared with the triple well type.

FIG. 5 is a cross sectional view showing an example of N-channel MOS transistors. The N-channel transistor 31 is formed in a P-type substrate 34. A junction capacitance Cj is formed between an N-type diffusion layer 35 of the N-channel transistor 31 and the P substrate 34. The junction capacitance Cj is about 0.5 fF (femto-farads, $1\times10^{-15}$ F) per square micrometer of the N diffusion layer 35. As shown in FIG. 5, the P-type substrate 34 is connected to a node with the $V_{BB}$ substrate potential via a sub-contacts Sc.

FIG. 6 illustrates an inverter 40 which is composed of a P-channel transistor 41 and an N-channel transistor 32. Here, it is supposed that the N-channel transistor 32 in the inverter 40 is shown in FIG. 5. When the inverter 40 operates, the potential at a node a changes. At this time, the potential $V_{BB}$ of the P-type substrate 34 locally receives a high frequency noise through coupling to an N-type diffusion layer 36*a* where a signal is supplied from the P substrate 34 shown in FIG. 5. As a result, the $V_{BB}$ potential for the N-channel transistor 31 will be affected by the noise.

Similarly, the two transistors M1 and M2 in the constant current source circuit 10 shown in FIG. 1 are laid out in the same manner as the N-channel transistor 31 shown in FIG. 5 and will be affected by the high frequency $V_{BB}$ noise. Also, the nodes B and D shown in FIGS. 1 and 3 are coupled to the $V_{BB}$ potential by the junction capacitance of the N diffusion layer and the capacitance of the wiring line, as well as a parasitic capacitance of the resistor $R_1$. Therefore, when the high frequency $V_{BB}$ noise which has a frequency higher than a frequency for a time constant of the parasitic capacitance of the resistor $R_1$ and the resistor $R_1$, the potentials of the nodes B and D may fluctuate at substantially the same amplitude and phase as those of the high frequency $V_{BB}$ noise (coupling noise).

On the other hand, the source of the transistor M1 is connected directly to the GND potential so that the potential at the source is hardly affected by the $V_{BB}$ noise. Accordingly, the gate—source voltage $V_{GS}$ of the transistor M1 (in this example, the gate is connected to the node B and the source is connected to the GND potential) is varied depending on the $V_{BB}$ noise. However, the gate—source voltage $V_{GS}$ of the transistor M2 (in this example, the gate is connected the node B and the source is connected to the node D) fluctuates at the same phase as the $V_{BB}$ noise so that the potential $V_{GS}$ does not change. As shown in FIG. 2, the sub-threshold characteristic curve of the transistor M1 changes in an exponential function with the change of the voltage $V_{GS}$. Hence, if the voltage $V_{GS}$ is increased by the $V_{BB}$ noise, an exponentially increased current flows. This causes the average potential of the node B to drop lower, compared with no application of the $V_{BB}$ noise. Accordingly, the voltage $V_{GS}$ of the transistor M2 will be smaller, since the potentials of the nodes B and D fluctuate at the same phase as the $V_{BB}$ noise, compared with no introduction of the $V_{BB}$ noise. When the $V_{BB}$ noise is present, the current I2 is decreased.

In this way, when the $V_{BB}$ potential receives a high frequency noise, a difference in the average current between the two transistors M1 and M2 is caused. As a result, the output current Iout will be smaller. In the reference potential generating circuit 20 shown in FIG. 3, the output voltage Vout will also be decreased.

When the $V_{BB}$ potential is changed locally as shown in FIGS. 5 and 6, the $V_{BB}$ noise has as a higher frequency as over a few gigahertz ($1\times10^9$ GHz). Also, in case that the semiconductor device is operated in synchronous with a clock signal supplied externally, the $V_{BB}$ potential may receive a noise of the same frequency. The frequency ranges from some hundreds kilohertz to some hundreds megahertz.

In conjunction with the above description, a semiconductor biasing circuit is disclosed in Japanese Laid Open Patent Application (JP-A-Heisei 2-115911). In this reference, a source of a P-channel enhancement FET (Q3) is connected to a DC potential $V_{DD}$. An N-channel enhancement FET (Q1) is connected at its drain to a drain of the P-channel enhancement FET (Q3) and at its source to a common potential point. A P-channel enhancement FET (Q4) is connected at its source to the DC potential $V_{DD}$. An N-channel enhancement FET (Q2) is connected at its drain to a drain of the P-channel enhancement FET (Q4) and at its source to the common potential point via a resistor R1. A P-channel enhancement FET (Q5) is connected at its source to the DC potential $V_{DD}$ and its drain to another DC potential $V_{SS}$, which is lower than the DC potential $V_{DD}$, via a load resistor RL. A P-channel enhancement FET (Q6) is connected at its source to the DC potential $V_{DD}$ and at its drain to the common potential point. A first control circuit connects the drain of the N-channel enhancement FET (Q1) to the gates of the N-channel enhancement FETs (Q1 and Q2) and the gate of the P-channel enhancement FET (Q6), respectively. A second control circuit connects the drain of the P-channel enhancement FET (Q4) to the gates of the P-channel enhancement FETs (Q4, Q3 and Q5), respectively. A constant current circuit is interposed between the common potential point and the other potential $V_{SS}$.

Also, a constant current circuit is disclosed in Japanese Laid Open Patent Application (JP-A-Heisei 4-097405). In this reference, the constant current circuit is composed of a band gap circuit including a resistor and a MOS transistor for giving a band gap potential between two MOS transistors, and a current mirror circuit for supplying constant currents to the two MOS transistors. An output added to the current mirror circuit is fed back as a part of the band gap potential.

Also, a constant current circuit is disclosed in Japanese Laid Open Patent Application (JP-A-Heisei 5-191166). In this reference, a MOS transistor M1 is connected at its source to the ground potential and at its drain to its gate via a resistor R and to a source of a MOS transistor M3. A MOS transistor M2 is connected at its source to the ground potential, and at its drain to a drain of the source of the MOS transistor M4. The MOS transistors M1 and M2 have the same ability. The MOS transistors M3 and M4 are used in a current mirror circuit which drives the MOS transistors M1 and M2. The MOS transistors M3 and M4 have an ability ratio of M3:M4=k:1. In other words, the MOS transistors M1 and M2 operates in a current ratio of K:1. As a result, a drive current is not influenced by a power supply potential change and a threshold potential change.

Also, a constant current circuit is disclosed in Japanese Laid Open Patent Application (JP-A-Heisei 10-322163). In this reference, a first potential which is generated from a potential generating circuit and is proportional to temperature is supplied to an inversion input terminal of a differential amplifier circuit while a noise component is removed from the first potential by an external capacitor. A reference potential which does not have a temperature characteristic is supplied to a non-inversion input terminal of the differential amplifier circuit while a noise component is removed from the reference potential by an external capacitor. Thus, a second potential is generated from the differential amplifier circuit and a current mirror circuit generates a reference current which is proportional to temperature, based on the second potential.

SUMMARY OF THE INVENTION

Therefore, an object of the present invention is to provide a semiconductor device with a constant current source circuit which can hardly be affected by any noise.

In order to achieve an aspect of the present invention, a semiconductor device with a constant current source circuit includes a current mirror circuit, third and fourth transistors, a first resistor and a potential change transferring section. The current mirror circuit includes first and second transistors which are connected to a line of a power supply potential and supply first and second currents, respectively. Each of the third and fourth transistors has a control electrode and first and second electrodes. The control electrode is operatively coupled to a first potential. The first electrode and the control electrode in the third transistor are connected to a first node, and the control electrode of the fourth transistor is connected to the first node. The third and fourth transistors receive the first and second currents at the first electrodes from the current mirror circuit, respectively. The first resistor is connected between the second electrode of the fourth transistor and a second node. The potential change transferring section is connected to a second potential and the second node such that a change of potential difference between the first potential and the second potential is transferred to the second electrodes of the third and fourth transistors.

The potential change transferring section is provided to hold a potential difference between the control electrode and the second electrode in each of the third and fourth transistors when the potential difference between the first potential and the second potential changes.

Also, the second electrode of the third transistor is connected directly to the second node, and the potential change transferring section may include a second resistor connected between the second node and the second potential. In this case, the potential change transferring section further includes a first capacitor connected between the second node and the second potential. A combination of the first capacitor and the second resistor functions as a low pass filter with a cut-off frequency of $1/\{2\pi R_2(C_{(A)}+Co)\}$, where $R_2$ is a resistance of the second resistor, $C_{(A)}$ is a parasitic capacitance of the second node, and Co is a junction capacitance between a diffusion layer and a substrate on which the first to fourth transistors are formed. Also, the diffusion layer is formed to surround a region where the third and fourth transistors are formed.

Also, the potential change transferring section may include a low pass filter connected between the second node and the second potential.

Also, the potential change transferring section may include a third resistor connected between the second electrode of the third transistor and the second node, the second node being connected directly to the second potential. In this case, the third resistor has a resistance which meets a relation of $(I_2R_1-I_1R_3)$=constant, where $I_1$ and $I_2$ are the first and second currents, $R_1$ is a resistance of the first resistor and $R_3$ is a resistance of the third resistor.

Also, the potential change transferring section may include a fourth resistor connected between the second electrode of the third transistor and the second node, a second capacitor connected between the first potential and the second electrode of the fourth transistor, and a third capacitor connected between the first potential and the second electrode of the third transistor, the second node being connected directly to the second potential. In this case, $R_4C_3=R_1C_2$, where $R_4$ is a resistance of the fourth resistor, $C_3$ and $C_2$ are capacitances of the third and second capacitors, respectively, and $R_1$ is a resistance of the first resistor. Also, the second capacitor is a parasitic capacitor to the second electrode of the fourth transistor.

In order to achieve another aspect of the present invention, a constant current source circuit includes first to fourth transistors, a first resistor and a holding section. The first transistor has a source connected to a power supply line, and a gate and drain. The second transistor has a source connected to the power supply line, a gate connected to the gate of the first transistor and a drain of the second transistor. The third transistor has a drain connected directly to the drain of the first transistor and a gate of the third transistor via a first node, and a source connected to a second node. The fourth transistor has a drain connected directly to the drain of the second transistor, a gate connected to the gate of the third transistor via the first node, and a source, the third and fourth transistors being operatively coupled to a first potential. The first resistor is connected between the source of the fourth transistor and a second node which is operatively coupled to a second potential. The holding section holds a potential difference between the gate and the source in each of the third and fourth transistors when the potential difference between the first potential and the second potential changes.

The holding section may include a second resistor connected between the second node and the second potential. In this case, the holding section may further include a first capacitor connected between the second node and the second potential. A combination of the first capacitor and the second resistor functions as a low pass filter with a cut-off frequency of $1/\{2\pi R_2(C_{(A)}+Co)\}$, where $R_2$ is a resistance of the second resistor, $C_{(A)}$ is a parasitic capacitance of the second node, and Co is a junction capacitance between a diffusion layer and a substrate on which the first to fourth transistors are formed. Also, the diffusion layer is desirably formed to surround a region where the third and fourth transistors are formed.

Also, the holding section may include a third resistor interposed between the source of the third transistor and the second node, the second node being connected directly to the second potential.

Also, the holding section may include a fourth resistor interposed between the source of the third transistor and the second node, a second capacitor connected between the first potential and the source of the fourth transistor, and a third capacitor connected between the first potential and the source of the third transistor, the second node being connected directly to the second potential. In this case, $R_4C_3=R_1C_2$, where $R_4$ is a resistance of the fourth resistor, $C_3$ and C2 are capacitances of the third and second capacitors, respectively, and $R_1$ is a resistance of the first resistor.

DESCRIPTION OF THE PREFERRED EMBODIMENTS

Hereinafter, a semiconductor device with a constant current source circuit of the present invention will be described with reference to the attached drawings.

Figure 7:
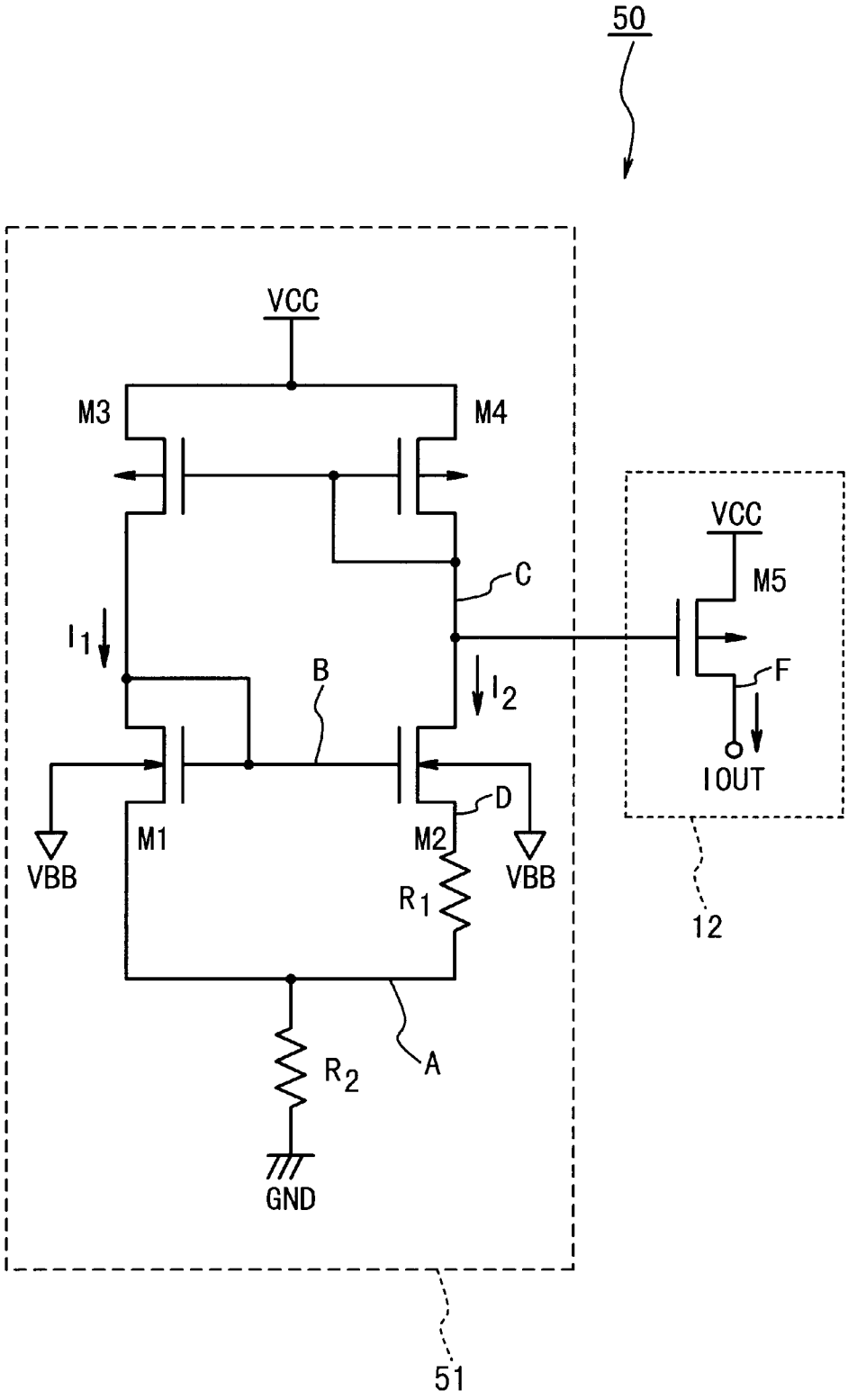
FIG. 7 is a circuit diagram showing a semiconductor device with a constant current source circuit according to a first embodiment of the present invention.

FIG. 7 shows the semiconductor device with the constant current source circuit according to the first embodiment of the present invention. Referring to FIG. 7, a constant current source circuit 50 is composed of a constant current source section 51 and an output section 12.

The constant current source section 51 is composed of a current mirror section, a drive section and a potential change transferring section. The current mirror section is composed of two P-channel MOS transistors M3 and M4. The drive section is composed of two N-channel MOS transistors M1 and M2 and a resistor $R_1$. The potential change transferring section is composed of a resistor $R_2$.

The current mirror circuit drives the drive circuit including the transistors M1 and M2. The transistor M1 has a source connected to a node A, i.e., the ground (GND) potential via the resistor $R_2$ and a gate and a drain connected directly to each other. The transistor M2 is connected at its source to the ground potential via the resistors $R_1$ and $R_2$, at its gate to the train of the transistor M1, and at its drain to the drain of the transistor M4. The two P-channel MOS transistors M3 and M4 are connected at their sources commonly to a power supply potential $V_{CC}$ and at their gates to each other. The drain of the transistor M3 is connected directly to the drain and gate of the transistor M1. The drain of the transistor M4 is connected directly to the gate of the transistor M4 and to the drain of the transistor M2. The transistors M1 to M4 form a Widlar current mirror circuit.

The output section 12 is composed of a P-channel MOS transistor M5. The transistor M5 is connected at its source directly to the power supply potential $V_{CC}$ and at the gate to a node C between the drain of the transistor M2 and the drain of the transistor M4 in the constant current source section 51. An output current Iout is outputted from a node F connected to the drain of the transistor M5.

Figure 1:
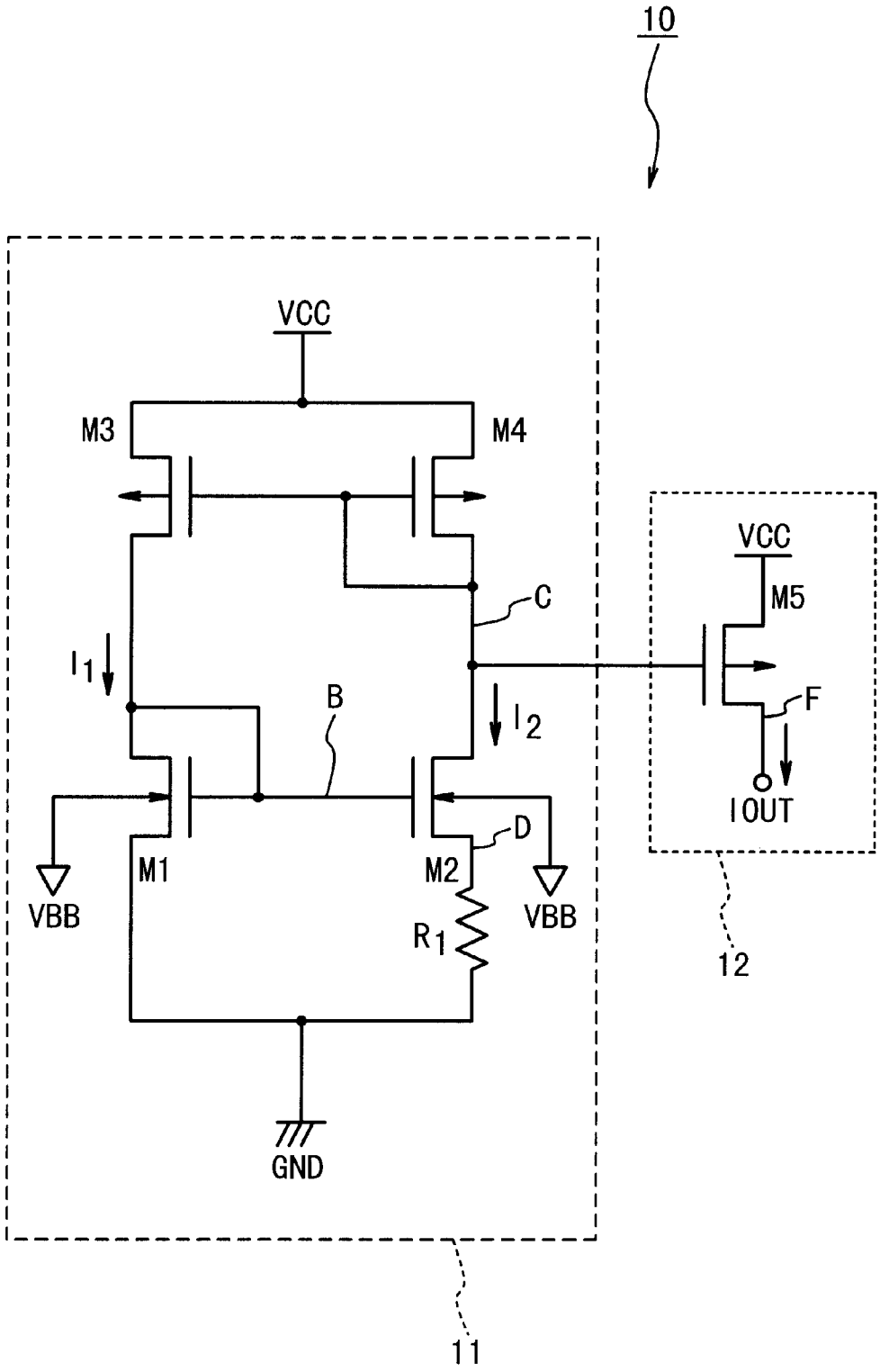
Fig. 1 PRIOR ART
FIG. 1 is a circuitry diagram of a semiconductor device with a conventional constant current source circuit.

As described above, the constant current circuit 50 shown in FIG. 7 is different from the conventional constant current source circuit 10 shown in FIG. 1 in that the resistor $R_2$ is provided in the constant current source section 51. The resistor $R_2$ is arranged to connect the source of the transistor M1 and the resistor $R_1$ to the ground (GND) potential. The resistor $R_2$ sets the source of the transistor M2 at node D to the same condition as the source of the transistor M1 for $V_{BB}$ noise. Here, the $V_{BB}$ potential is a substrate potential and the $V_{BB}$ noise includes the noise applied to the $V_{BB}$ potential. For the above reason, the resistor $R_2$ prevents the source of the transistor M1 from being directly connected to the ground potential. The resistance of the resistor $R_2$ is not limited but can be set to a desired value.

Figure 2:
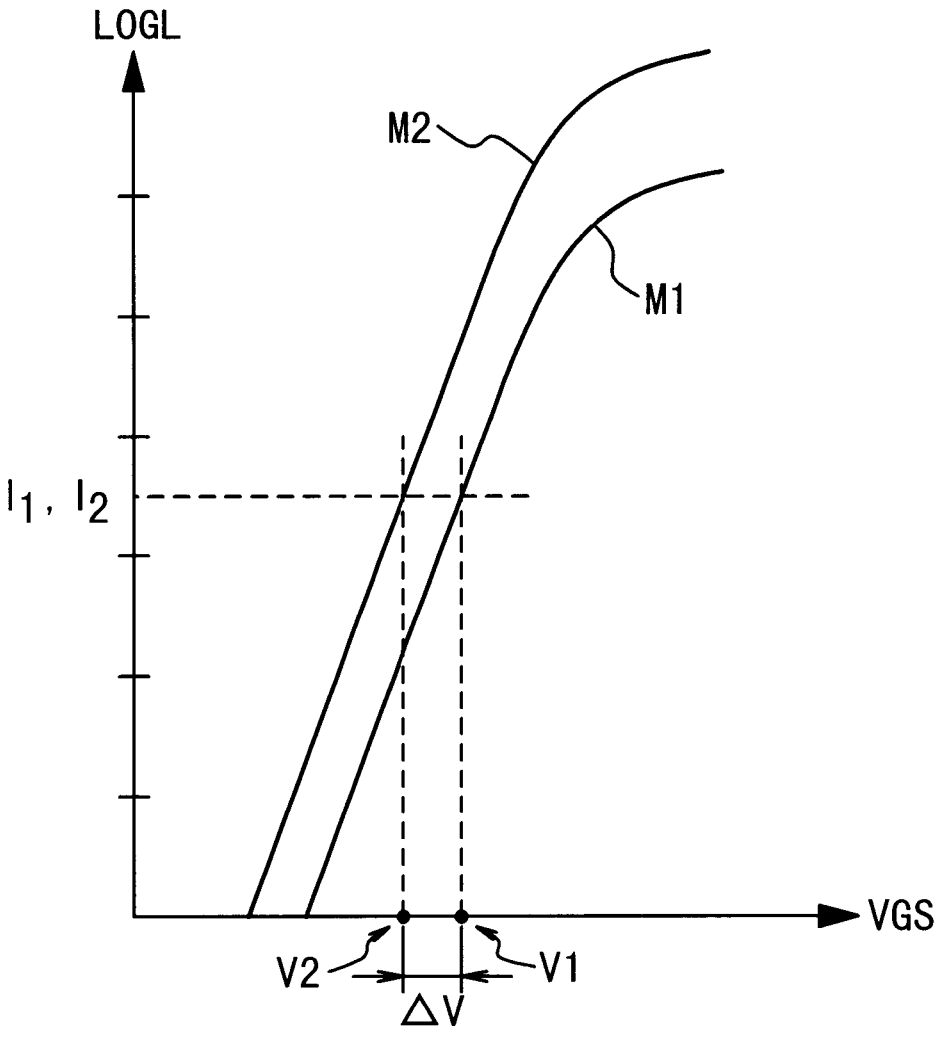
Fig. 2 PRIOR ART
FIG. 2 is a graph showing a relation between gate—source voltage $V_{GS}$ and current I in two transistors of the conventional semiconductor device shown in FIG. 1.
Figure 3:
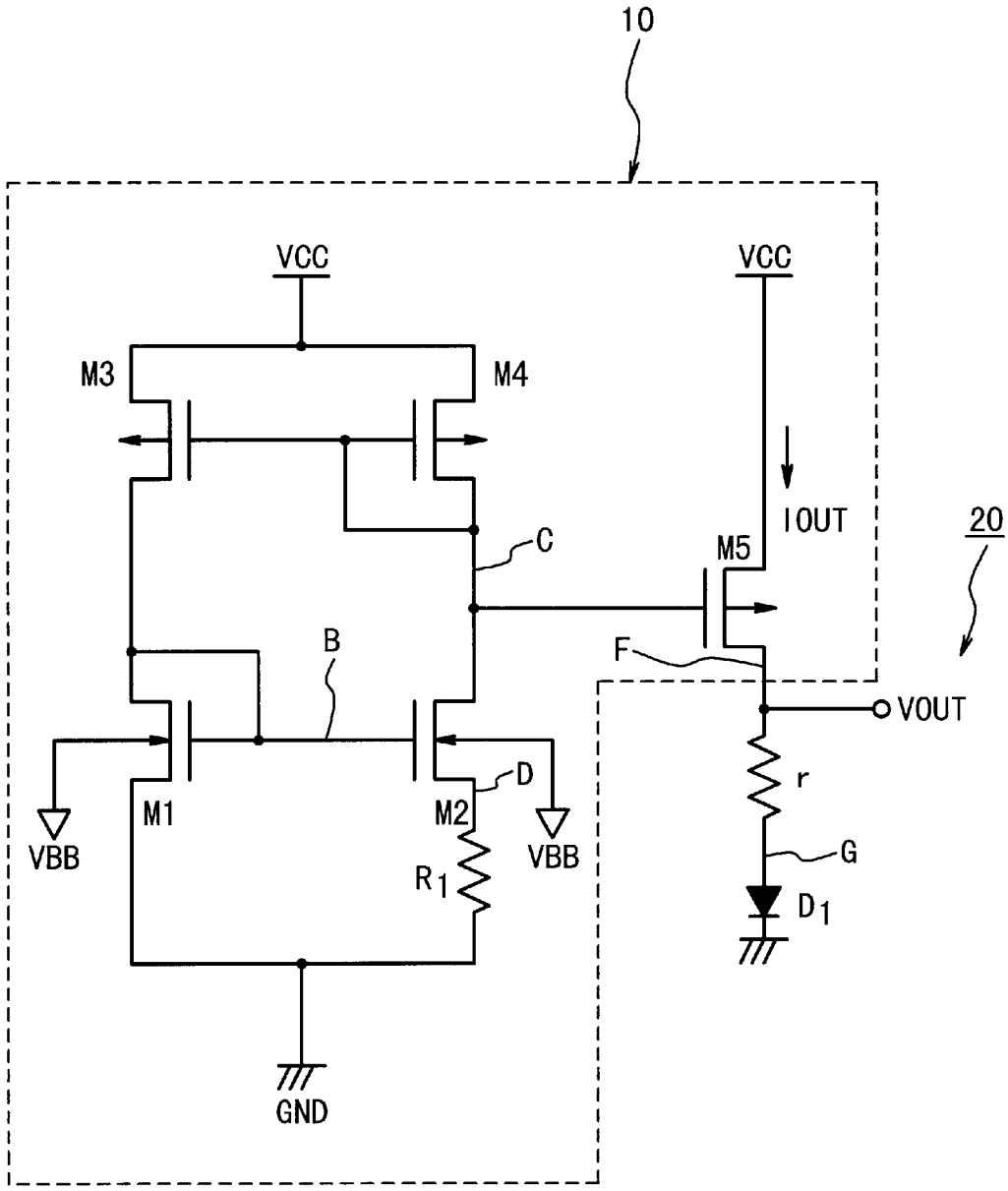
Fig. 3 PRIOR ART
FIG. 3 is a circuit diagram of a reference potential generating circuit to which the conventional constant current source circuit shown in FIG. 1 is applied.
Figure 4:
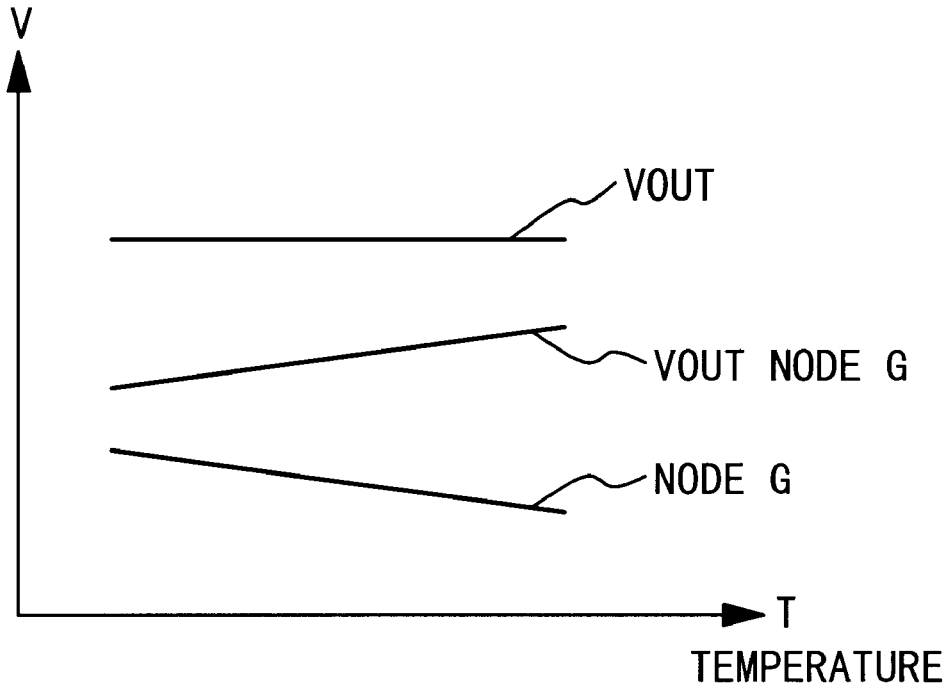
Fig. 4 PRIOR ART
FIG. 4 is a graphic diagram of the relation of temperature and output potential in the circuit shown in FIG. 3.

In the constant current source circuit 50, a parasitic capacitance including a wiring line capacitance and a junction capacitance of an N-type diffusion of the transistor M1 is connected to the node A. If a high frequency noise is applied to the $V_{BB}$ potential, the potential of the node A is synchronized with the $V_{BB}$ noise and fluctuates at the same amplitude as the $V_{BB}$ noise. For this reason, the potentials of the nodes A, B, and D are coupled with the $V_{BB}$ noise and fluctuate at the same phase and the same amplitude as the $V_{BB}$ noise. This allows the $V_{GS}$ voltages of the transistors M1 and M2, i.e., $V_{GS(M1)}$ and $V_{GS(M2)}$ corresponding to V1 and V2 shown in FIG. 2 to be kept constant against the $V_{BB}$ noise. Even when the $V_{BB}$ noise is present, the relation of (V1=ΔV+V2) described with reference to FIG. 2 is guaranteed. Hence, the output current Iout can always be kept at a constant current regardless of a high frequency $V_{BB}$ noise.

In the above description, it is considered that the $V_{BB}$ potential changes with the high frequency noise with reference to the GND level. In case that the $V_{BB}$ potential is the reference potential, the ground potential changes with the high frequency noise. In the constant current source circuit 50, even if the noise is applied to the $V_{BB}$ potential, the $V_{GS}$ voltages of the transistors M1 and M2 do not change, because the nodes A, B, and D are coupled to the $V_{BB}$ potential. Instead, the ground (GND) potential is affected by the noise.

Figure 8:
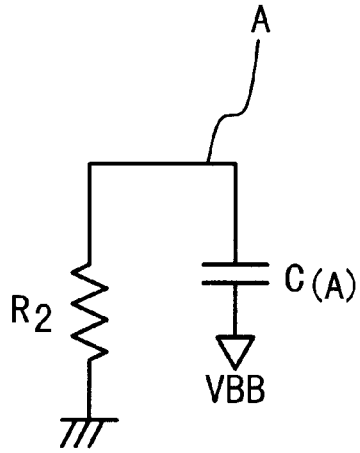
FIG. 8 is a part of an equivalent circuit of the circuit shown in FIG. 7.
Figure 9:
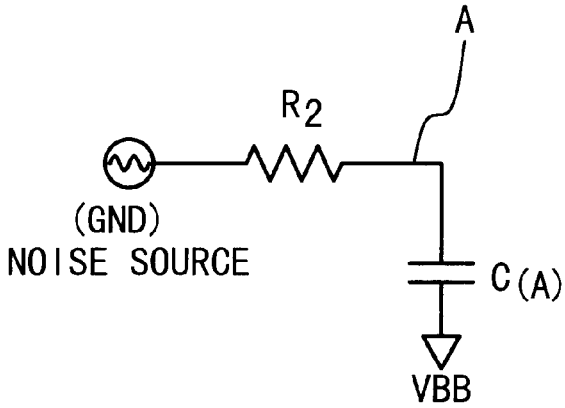
FIG. 9 illustrates an equivalent circuit of that shown in FIG. 8.

FIG. 8 shows in detail, the connection between the node A and the ground potential shown in FIG. 7. FIG. 9 shows an equivalent circuit to that shown in FIG. 8. As seen from FIGS. 7 to 9, the resistor $R_2$ permits the noise to propagate from the ground potential to the node A. Since the cut-off frequency is $1/(2\pi R_2 C_{(A)})$ Hz, where $C_{(A)}$ is a parasitic capacitance of the node A. The resistor $R_2$ and the capacitor $C_{(A)}$ functions as a low pass filter. In the constant current source circuit 50, supposing that $R_2$ is 100 kΩ and $C_{(A)}$ is 10 fF, the cut-off frequency is about 160 MHz. The constant current source circuit 50 is effective to the $V_{BB}$ noise having a frequency higher than about 160 MHz, resulting in a more stable level of the output current Iout.

It should be noted that the ratios of the transistors M3 and M4 are identical to each other but the ratios of the transistors M1 and M2 are different from each other in the constant current source circuit 10 shown in FIG. 1. However, the constant current circuit 50 of the present invention does not requires to have the ratios of the two transistors M3 and M4 identical to each other. For example, in the constant current source circuit 50, the two transistors M3 and M4 may be different in the ratio from each other while the other two transistors M1 and M2 may be identical in the ratio to each other.

Figure 10:
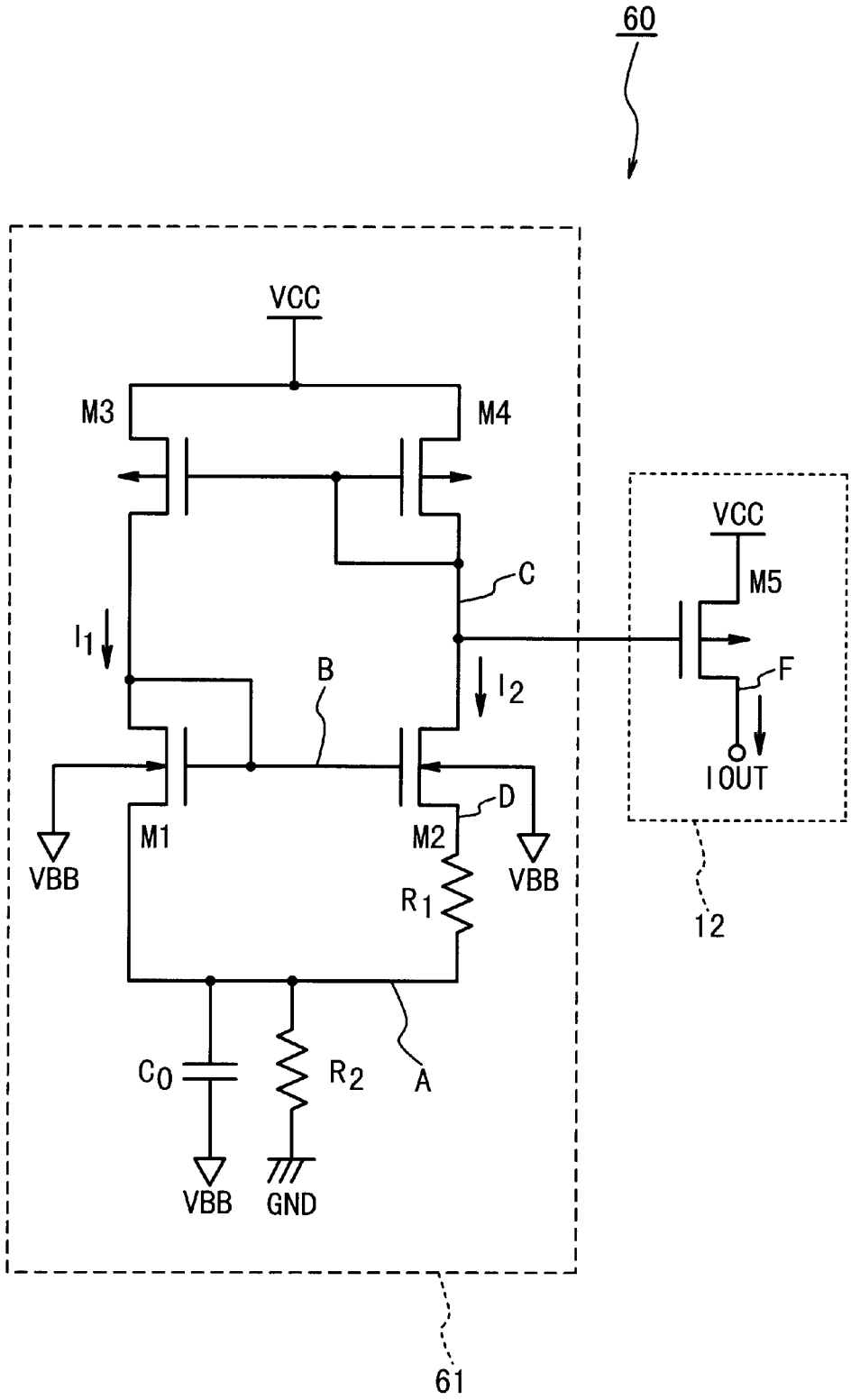
FIG. 10 is a circuit diagram showing a semiconductor device with a constant current source circuit according to a second embodiment of the present invention.

Next, the semiconductor device with the constant current source circuit according to the second embodiment of the present invention will now be described with reference to FIG. 10. A constant current source section 61 of the constant current source circuit 60 in the second embodiment has the node A added with a capacitance Co which is connected to the $V_{BB}$ potential and not provided in the constant current source section 51 shown in FIG. 7. The addition of the capacitance Co changes the cut-off frequency to $1/\{2\pi R_2(C_{(A)}+Co)\}$ Hz. Accordingly, the constant current circuit 60 in the second embodiment will be effective to cut off the $V_{BB}$ noise having a frequency lower than that of the constant current source circuit 50.

Figure 5:
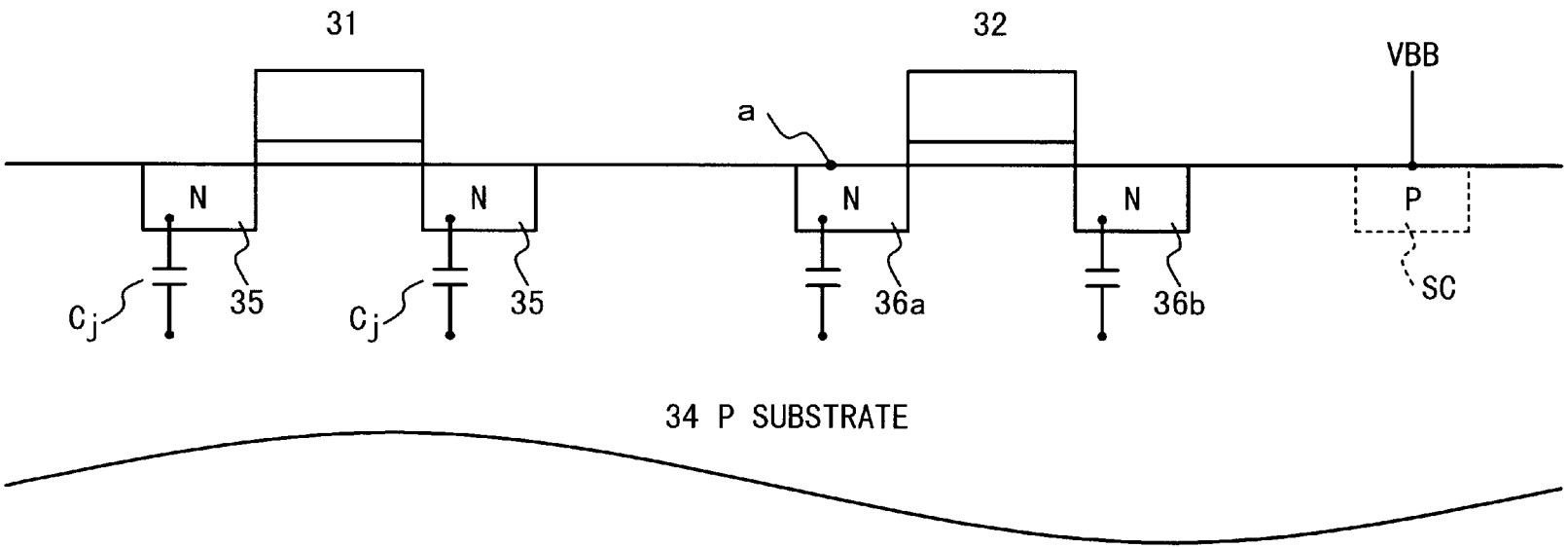
Fig. 5 PRIOR ART
FIG. 5 is a cross sectional view of conventional MOS transistors formed on a substrate.
Figure 6:
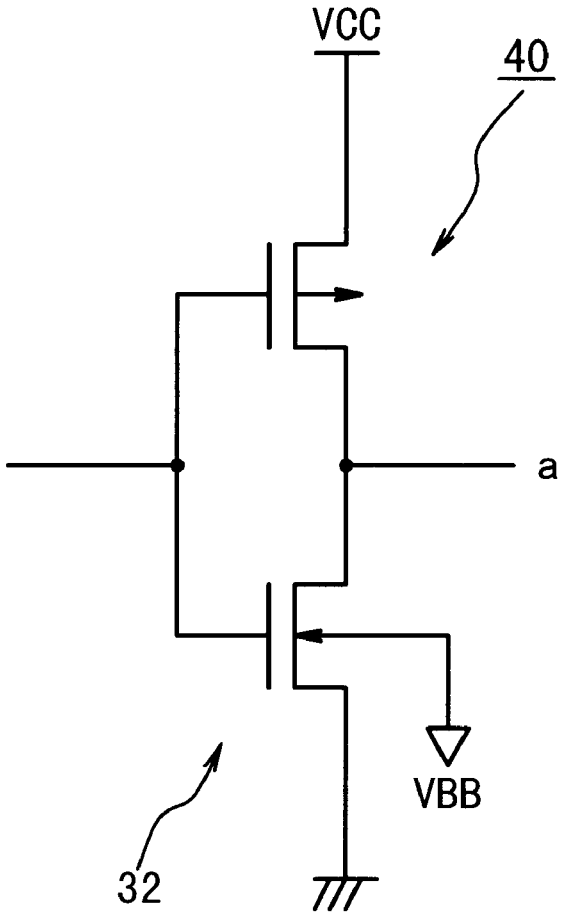
Fig. 6 PRIOR ART
FIG. 6 is a diagram showing a conventional inverter.

The capacitance Co may be provided as a wiring line capacitance or a gate capacitance of the transistor. However, it is desirable that the capacitance Co is produced as a junction capacitance of an N-type diffusion layer which is a junction capacitance between the N-type diffusion layer and the P substrate. The N-type diffusion layer should be located nearer to the transistors M1 and M2. Because the $V_{BB}$ noise is locally introduced as described above with reference to FIG. 5, the amplitude of the noise may vary depending on the distance of the N-type diffusion layer from the transistors M1 and M2.

Figure 11:
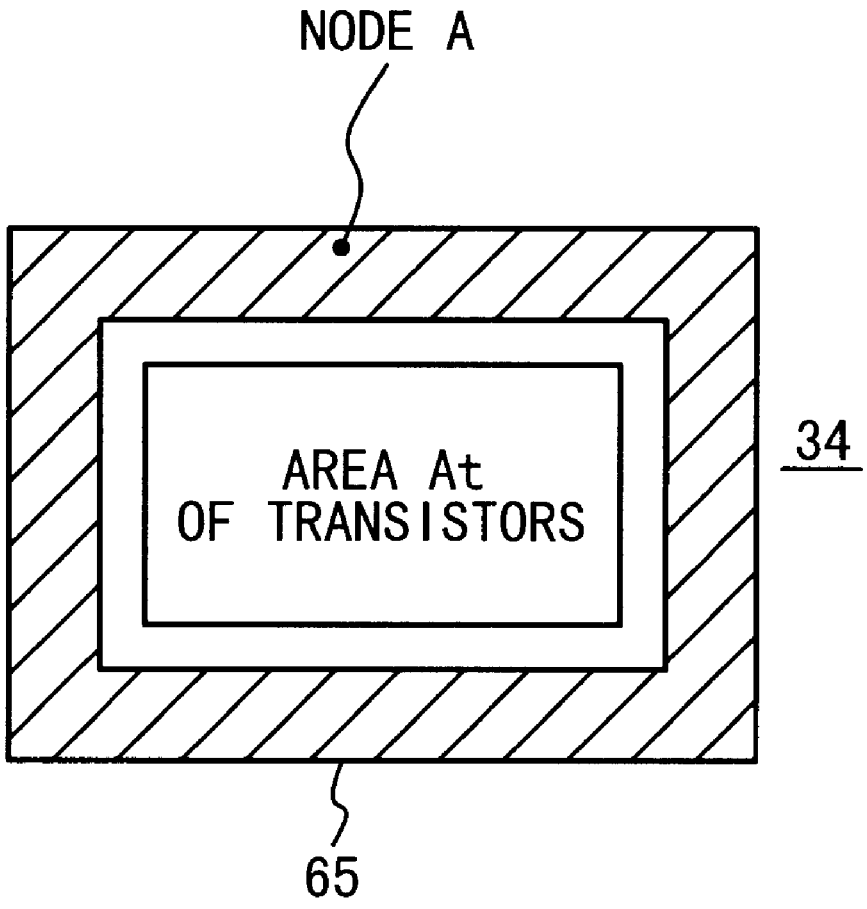
FIG. 11 is a plan view showing the arrangement of a capacitance and an N-type diffusion layer in the second embodiment.

FIG. 11 shows an exemplary layout of the capacitance Co. The N-type diffusion layer 65 is laid out in a P-type substrate 34 so that the layer 65 encloses the region At of the transistors M1 and M2. This allows the nodes A to D to uniformly receive the influence of the $V_{BB}$ noise at a closer distance. Hence, a change in the output current Iout due to the $V_{BB}$ noise can be almost eliminated.

Also, if the N-type diffusion layer 65 shown in FIG. 11 is 100 $\mu m^2$, the capacitance Co is about 500 fF. When $R_2$ is 100 kΩ, the cut-off frequency is as low as about 3.2 MHz. Accordingly, the circuit can be effective to the $V_{BB}$ noise of a lower frequency. Therefore, a change in the output current Iout can be further restrained. In a semiconductor device in which the $V_{BB}$ noise of a further lower frequency may be generated, the capacitance Co and the resistance of the resistor $R_2$ can be desirably selected and adjusted in accordance with the frequency of the $V_{BB}$ noise.

Figure 12:
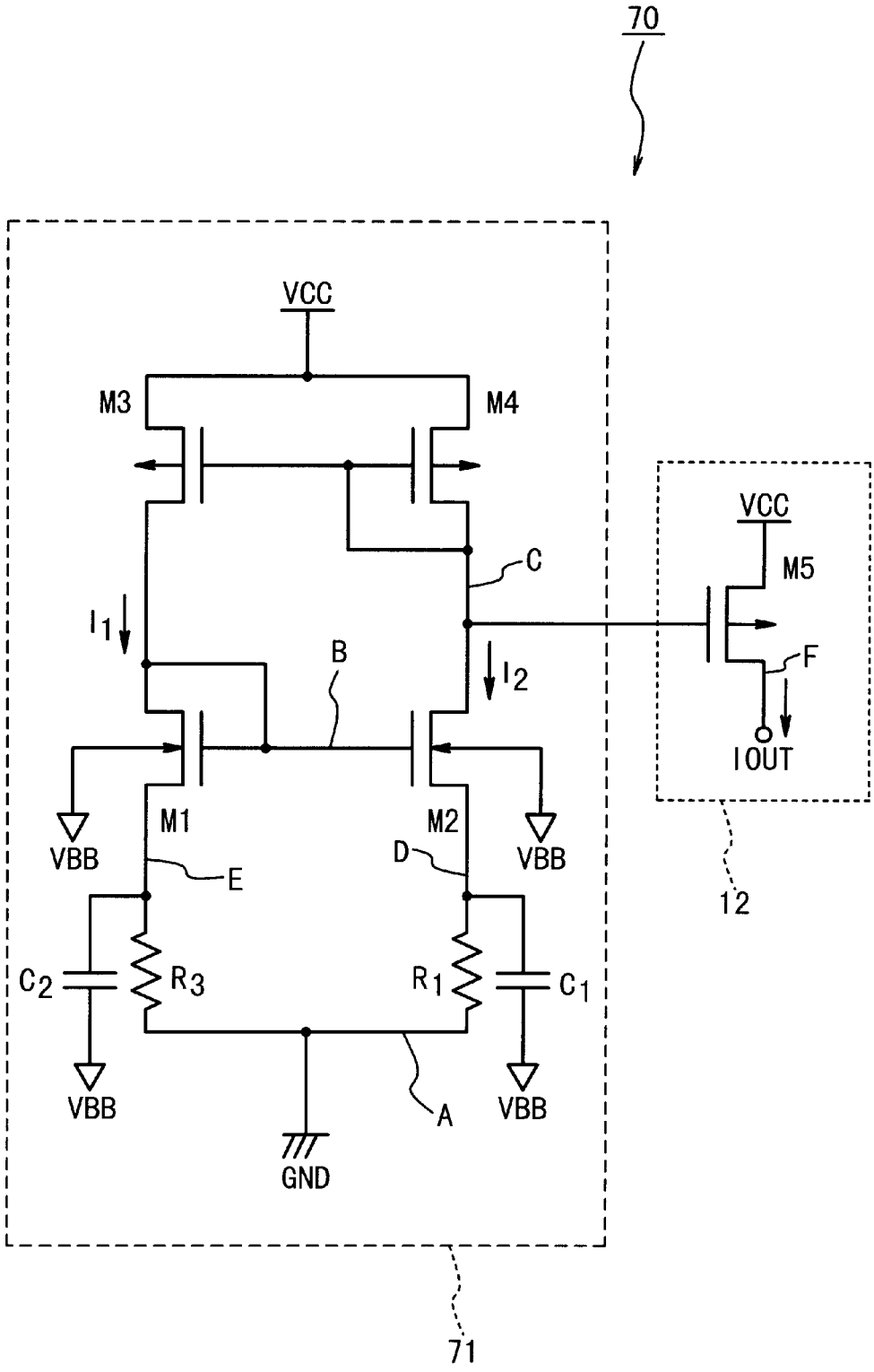
FIG. 12 is a circuit diagram showing a semiconductor device with a constant current source circuit according to a third embodiment of the present invention.

Next, the semiconductor device with the constant current source circuit according to the third embodiment of the present invention will be described with reference to FIG. 12. In the third embodiment, a constant current source circuit 70 including a constant current source section 71 will be described in comparison with the constant current 10 shown in FIG. 1.

A resistor $R_3$ is provided between the source of the transistor M1 as a node E and the GND potential. A capacitance $C_2$ is connected between the node E and the $V_{BB}$ potential. Also, a capacitance $C_1$ is provided between the $V_{BB}$ potential and a node D between the source of the transistor M2 and the resistor $R_1$.

Figure 13:
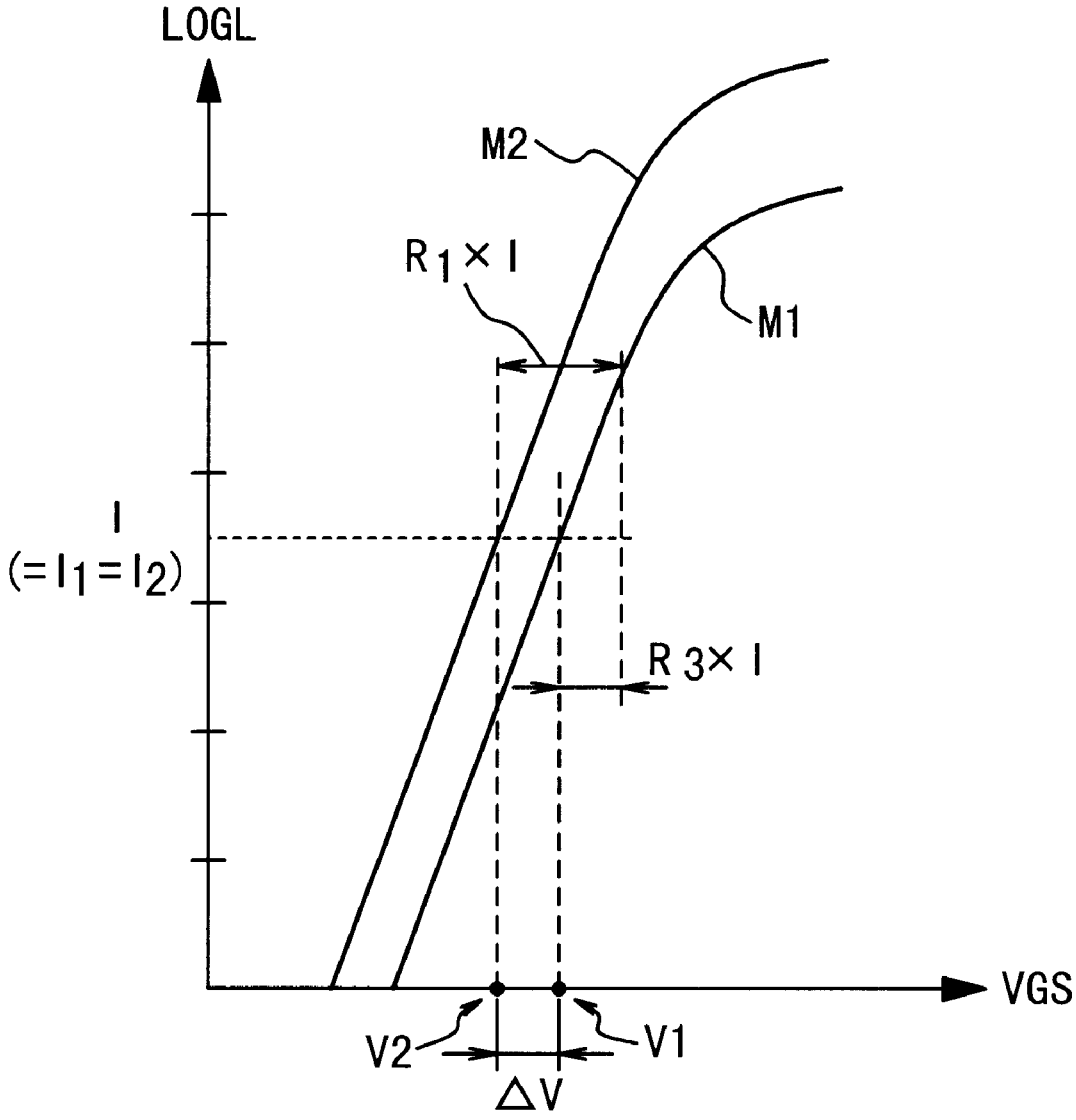
FIG. 13 is a graphic diagram showing the relation of gate—source potential $V_{GS}$ and current I in two transistors of the third embodiment.

Referring to FIG. 13, the operation principle of the constant current source circuit 70 will be described. For simplification of the description, it is supposed that the ratio of the transistor M3 is identical to that of the transistor M4. This produces $I=I_1=I_2$.

$$R_1 \times I = \Delta V + R_3 \times 1 \quad (11)$$

$$I = \Delta V/(R_1 - R_3) \quad (12)$$

$$Iout = \{\Delta V/(R_1 - R_3)\} \times (\textbf{M5 ratio}/\textbf{M4 ratio}) \quad (13)$$

From the equation (13), the output current Iout is determined based on the ratios of the transistors M1 to M5 and the resistances of the resistor $R_1$ and $R_3$.

The cut-off frequency to the $V_{BB}$ noise at the node E is $1/(2\pi R_3 C_2)$ Hz and the cut off frequency to the $V_{BB}$ noise at the node D is $1/(2\pi R_1 C_1)$ Hz. When the capacitances $C_1$ and $C_2$ are determined so that $R_3 \times C_2 = R_1 \times C_1$, both of the cut-off frequencies becomes same. In this case, because $R_3$ and $R_1$ determine the currents, $C_1$ and $C_2$ are used to adjust a time constant. At this time, the two nodes D and E fluctuate in an alternate manner at the same phase and the same amplitude as the $V_{BB}$ noise against the $V_{BB}$ noise with any frequency. This means that the $V_{GS}$ voltages of the transistors M1 and M2 are identical in alternate change against the $V_{BB}$ noise. Hence, the two transistors M1 and M2 can output the corresponding currents in the alternate manner. More specifically, when the $V_{BB}$ noise has a frequency lower than the cut-off frequency determined based on $R_3 \times C_2$ and $R_1 \times C_1$, the transistors M1 and M2 can flow currents in correspondence to the $V_{BB}$ noise. This allows the constant current source circuit 70 to always keep the output current Iout constant, regardless that the $V_{BB}$ noise has any frequency components.

It should be noted that the capacitance $C_1$ is the capacitance of an extra capacitor added to the constant current source circuit 50 shown in FIG. 7. However, a parasitic capacitance of the node D to the $V_{BB}$ potential may be used as the capacitance $C_1$ with no extra capacitor added to the constant current source circuit 50 shown in FIG. 7. A modification of the third embodiment may be realized by the constant current source circuit 50 of FIG. 7 accompanied with the resistor $R_3$ and the capacitor $C_2$.

Next, the semiconductor device with the constant current source circuit 80 according to 3 the fourth embodiment of the present invention will now be described referring to FIG. 14.

Figure 14:
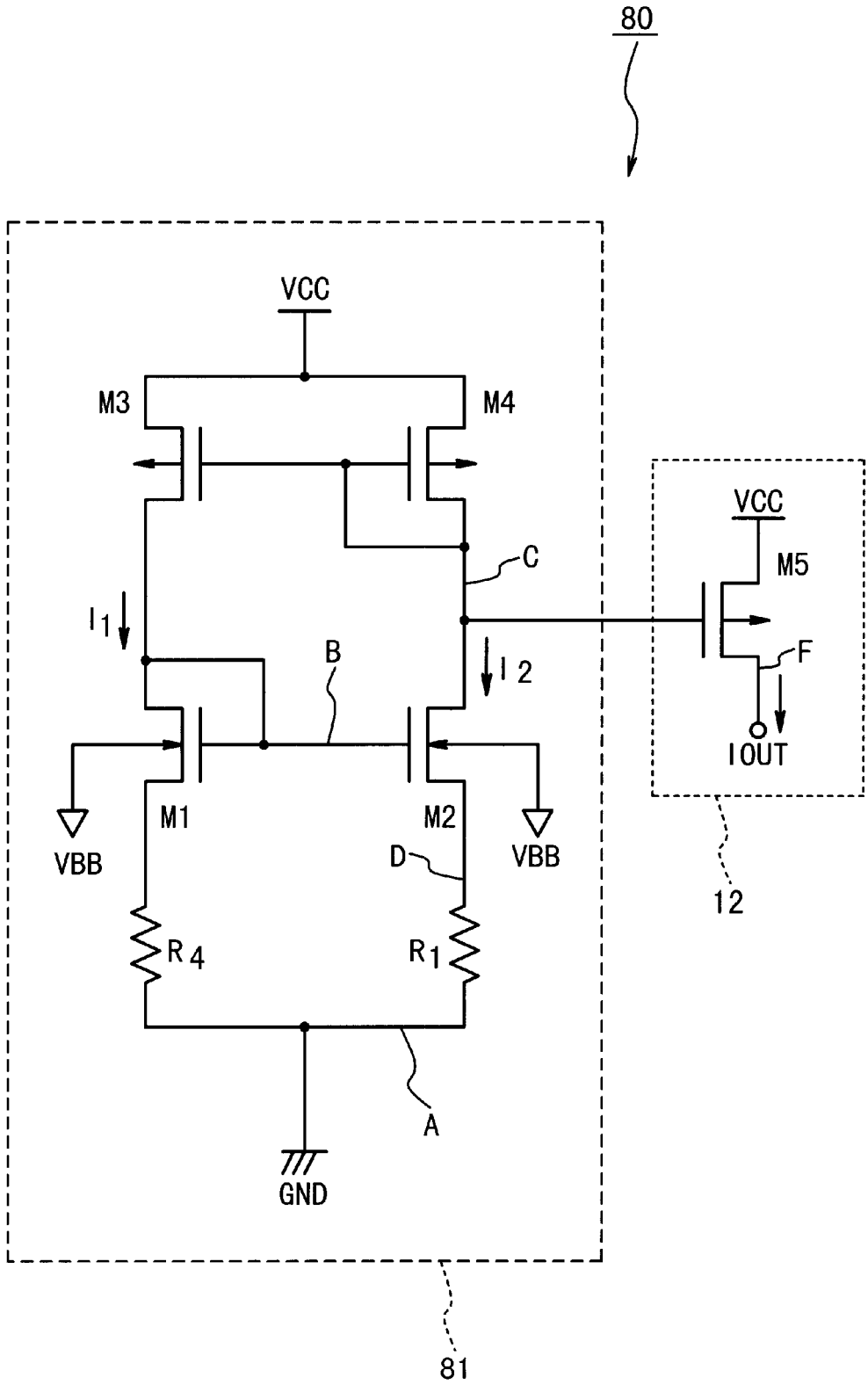
FIG. 14 is a circuit diagram showing a semiconductor device with a constant current source circuit according to a fourth embodiment of the present invention.

As shown in FIG. 14, the constant current circuit 80 includes a resistor $R_4$ connected between the source of the transistor M1 and the node A which is connected to the ground potential. As the resistor $R_4$ has a parasitic capacitance, the potentials at the nodes B and D coupled to the $V_{BB}$ potential change at substantially the same phase and the same amplitude as the $V_{BB}$ noise. As a result, the $V_{GS}$ voltages of the transistors M1 and M2 can be always kept constant in relation to the $V_{BB}$ potential.

In the constant current source circuit 80, the resistance of the resistor $R_4$ has to be different from that of the resistor $R_1$. If the M3 ratio equals to the M4 ratio and $I_1=I_2=I$, the relation $\Delta V=(IR_1-IR_4)$ is not satisfied.

As described above, the semiconductor device according to the present invention can hardly be susceptible to the noise.

What is claimed is:

1. A semiconductor device with a constant current source circuit comprising:

a current mirror circuit including first and second transistors, connected to a line of a power supply potential, and respectively supplying first and second currents;

third and fourth transistors, each of which has a control electrode and first and second electrodes, and said control electrode is operatively coupled to a first potential, wherein said first electrode and said control electrode in said third transistor are connected to a first node, said control electrode of said fourth transistor is connected to said first node, and said third and fourth transistors receive said first and second currents at said first electrodes from said current mirror circuit, respectively;

a first resistor connected between said second electrode of said fourth transistor and a second node; and a potential change transferring section connected to a second potential and said second node such that a change of potential difference between said first potential and said second potential is transferred to said second electrodes of said third and fourth transistors.

2. A semiconductor device according to claim 1, wherein said potential change transferring section holds a potential difference between said control electrode and said second electrode in each of said third and fourth transistors when said potential difference between said first potential and said second potential changes.

3. A semiconductor device according to claim 1, wherein said second electrode of said third transistor connected directly to said second node, wherein said potential change transferring section includes a second resistor connected between said second node and said second potential.

4. A semiconductor device according to claim 3, wherein said potential change transferring section further includes a first capacitor connected between said second node and at least one of said first potential and said second potential.

5. A semiconductor device according to claim 4, wherein a combination of said first capacitor and said second resistor functions as a low pass filter with a cut-off frequency of $1/\{2\pi R_2(C_{(A)}+Co)\}$, where $R_2$ is a resistance of said second resistor, $C_{(A)}$ is a parasitic capacitance of said second node, and Co is a junction capacitance between a diffusion layer and a substrate on which said first to fourth transistors are formed.

6. A semiconductor device according to claim 5, wherein said diffusion layer is formed to surround a region where said third and fourth transistors are formed.

7. A semiconductor device according to claim 1, wherein said potential change transferring section comprises a low pass filter interconnected between said second node, said first potential, and said second potential.

8. A semiconductor device according to claim 1, wherein said potential change transferring section includes:

a third resistor connected between said second electrode of said third transistor and said second node, said second node being connected directly to said second potential.

9. A semiconductor device according to claim 8, wherein said third resistor has a resistance which meets a relation of $(I_2R_1-I_1R_3)$=constant, where $I_1$ and $I_2$ are said first and second currents, $R_1$ is a resistance of said first resistor and $R_3$ is a resistance of said third resistor.

10. A semiconductor device according to claim 1, wherein said potential change transferring section includes:

a fourth resistor connected between said second electrode of said third transistor and said second node;

a second capacitor connected between said first potential and said second electrode of said fourth transistor; and a third capacitor connected between said first potential and said second electrode of said third transistor, said second node being connected directly to said second potential.

11. A semiconductor device according to claim 10, wherein $R_4C_3=R_1C_2$, where $R_4$ is a resistance of said fourth resistor, $C_3$ and $C_2$ are capacitances of said third and second capacitors, respectively, and $R_1$ is a resistance of said first resistor.

12. A semiconductor device according to claim 10, wherein said second capacitor is a parasitic capacitor to said second electrode of said fourth transistor.

13. A constant current source circuit comprising:

a first transistor having a drain connected to a power supply line, and a gate and a source;

a second transistor having a drain connected to said power supply line, a gate connected to said gate of said first transistor and a source of said second transistor;

a third transistor having a drain connected directly to said source of said first transistor and a gate of said third transistor via a first node, and a source connected to a second node;

a fourth transistor having a drain connected directly to said source of said second transistor, a gate connected to said gate of said third transistor via said first node, and a source, said third and fourth transistors being operatively coupled to a first potential;

a first resistor connected between said source of said fourth transistor and a second node which is operatively coupled to a second potential; and holding means for holding a potential difference between said gate and said source in each of said third and fourth transistors when said potential difference between said first potential and said second potential changes.

14. A constant current source circuit according to claim 13, wherein said holding means includes a second resistor connected between said second node and said second potential.

15. A constant current source circuit according to claim 14, wherein said holding means further includes a first capacitor connected between said second node and at least one of said first potential and said second potential.

16. A constant current source circuit according to claim 15, wherein a combination of said first capacitor and said second resistor functions as a low pass filter with a cut-off frequency of $1/\{2\pi R_2(C_{(A)}+Co)\}$, where $R_2$ is a resistance of said second resistor, $C_{(A)}$ is a parasitic capacitance of said second node, and Co is a junction capacitance between a diffusion layer and a substrate on which said first to fourth transistors are formed.

17. A constant current source circuit according to claim 16, wherein said diffusion layer is formed to surround a region where said third and fourth transistors are formed.

18. A constant current source circuit according to claim 13, wherein said holding means includes:

a third resistor interposed between said source of said third transistor and said second node, said second node being connected directly to said second potential.

19. A constant current source circuit according to claim 13, wherein said holding means includes:

a fourth resistor interposed between said source of said third transistor and said second node;

a second capacitor connected between said first potential and said source of said fourth transistor; and a third capacitor connected between said first potential and said source of said third transistor, said second node being connected directly to said second potential.

20. A constant current source circuit according to claim 19, wherein $R_4C_3=R_1C_2$, where $R_4$ is a resistance of said fourth resistor, $C_3$ and $C_2$ are capacitances of said third and second capacitors, respectively, and $R_1$ is a resistance of said first resistor.

21. A constant current source circuit having a first power supply node, a second power supply node, and a ground node, said second power supply having a polarity opposite said first power supply, said circuit comprising:

a first transistor having a first electrode connected to said first power supply node;

a second transistor having a first electrode connected to said first power supply node;

a third transistor having a first electrode connected to a second electrode of said first transistor, said third transistor having at least one component connected to said second power supply node, thereby causing said third transistor to be operatively coupled to said second power supply node relative to said ground node;

a fourth transistor having a first electrode connected to a second electrode of said second transistor, said fourth transistor having at least one component connected to said second power supply node, thereby causing said fourth transistor to be operatively coupled to said second power supply node relative to said ground node; and a low pass filter interconnected between said second power supply node, said ground potential node, and one electrode of at least one of said third transistor and said fourth transistor, said low pass filter thereby providing a noise immunity to said third transistor and said fourth transistor for voltage transients in at least one of said second power supply node and said ground node.

* * * * *